US009566814B2

(12) United States Patent
Koike et al.

(10) Patent No.: US 9,566,814 B2
(45) Date of Patent: Feb. 14, 2017

(54) INK JET RECORDING PROCESS, INK JET RECORDING APPARATUS, AND RECORDED MATTER

(71) Applicant: Seiko Epson Corporation, Tokyo (JP)

(72) Inventors: Naoki Koike, Matsumoto (JP); Atsushi Denda, Chino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/173,212

(22) Filed: Feb. 5, 2014

(65) Prior Publication Data

US 2014/0220319 A1 Aug. 7, 2014

(30) Foreign Application Priority Data

Feb. 5, 2013 (JP) ..... 2013-020169
Oct. 25, 2013 (JP) ..... 2013-221950

(51) Int. Cl.
*B41M 7/00* (2006.01)
*B41M 5/00* (2006.01)
*B41J 2/21* (2006.01)

(52) U.S. Cl.
CPC ..... *B41M 7/00* (2013.01); *B41J 2/2114* (2013.01); *B41M 5/0017* (2013.01); *B41M 5/0023* (2013.01); *B41M 7/009* (2013.01); *B41M 2205/40* (2013.01); *Y10T 428/24901* (2015.01)

(58) Field of Classification Search
CPC ..... B41M 7/00; B41M 5/0017; B41M 5/0023; B41J 2/2114; B41J 2/01; Y10T 428/24901
See application file for complete search history.

(56) References Cited

U.S. PATENT DOCUMENTS 5,818,486 A * 10/1998 Koike et al. ..... 347/101
6,241,344 B1 * 6/2001 Machida ..... 347/66
7,763,108 B2 7/2010 Oyanagi et al.
8,430,495 B2 * 4/2013 Oyanagi ..... D06P 5/30 106/31.6
8,888,228 B2 * 11/2014 Hirata et al. ..... 347/20
8,916,625 B2 * 12/2014 Denda et al. ..... 523/160
2002/0027587 A1 * 3/2002 Sugaya et al. ..... 347/104
2007/0044684 A1 * 3/2007 Nakano et al. ..... 106/31.86
2007/0142501 A1 * 6/2007 Oyanagi et al. ..... 523/160
2008/0001983 A1 * 1/2008 Kawakami et al. ..... 347/14
2008/0145628 A1 * 6/2008 Oyanagi et al. ..... 428/206
2008/0225100 A1 * 9/2008 Kumagai ..... 347/102
2008/0250970 A1 * 10/2008 Oyanagi et al. ..... 106/31.65
2009/0214833 A1 * 8/2009 Oyanagi et al. ..... 428/195.1
2010/0256283 A1 10/2010 Kagata et al.
(Continued)

FOREIGN PATENT DOCUMENTS

JP 2002-179960 A 6/2002
JP 2006-024485 A 1/2006
(Continued)

*Primary Examiner* — Sarah Al Hashimi
(74) *Attorney, Agent, or Firm* — Nutter McClennen & Fish LLP; John J. Penny, Jr.; Joshua I. Rudawitz

(57) ABSTRACT

An ink jet recording process using a glitter pigment provides satisfactory glitter even on a recording medium having a rough surface. The ink jet recording process includes a glitter image-forming step of forming a glitter image by discharging a glitter ink composition containing a glitter pigment to a recording medium and a pressing step of pressing the layer of the glitter image formed on the recording medium.

23 Claims, 2 Drawing Sheets

(56) References Cited

U.S. PATENT DOCUMENTS

| | | | | |
|---|---|---|---|---|
| 2010/0256284 | A1* | 10/2010 | Kagata | B82Y 30/00 524/441 |
| 2011/0135893 | A1* | 6/2011 | Oyanagi et al. | 428/196 |
| 2011/0172342 | A1* | 7/2011 | Tsukiana et al. | 524/441 |
| 2012/0040147 | A1* | 2/2012 | Komatsu et al. | 428/195.1 |
| 2012/0040155 | A1* | 2/2012 | Komatsu et al. | 428/204 |
| 2012/0249667 | A1* | 10/2012 | Hirata et al. | 347/20 |

FOREIGN PATENT DOCUMENTS

| | | | |
|---|---|---|---|
| JP | 2011-121215 | A | 6/2011 |
| JP | 2011-137164 | A | 7/2011 |
| WO | WO 2005075210 | A1 * | 8/2005 |

* cited by examiner

INK JET RECORDING PROCESS, INK JET RECORDING APPARATUS, AND RECORDED MATTER

Priority is claimed under 35 U.S.C. §119 to Japanese Application No. 2013-020169 filed on Feb. 5, 2013 and Japanese Application No. 2013-221950 filed on Oct. 25, 2013, are hereby incorporated by reference in its entirety.

BACKGROUND

1. Technical Field

The present invention relates to an ink jet recording process, an ink jet recording apparatus, and a recorded matter.

2. Related Art

Recently, a demand for printed matters having images having metallic gloss formed on recording surfaces has been increased, and methods for forming images having metallic gloss have been proposed. For example, a foil stamping recording process involving preparation of a recording medium having a highly flat recording surface and pressing of metal foil thereto, a method involving vacuum deposition of a metal onto a smooth recording surface of a plastic film, and a method involving application of a metallic pigment ink to a recording medium have been proposed.

An ink jet recording process is a method performing recording by discharging droplets of an ink composition such that the droplets adhere to a recoding medium such as paper. This recording process can record an image having high resolution and high quality at a high speed with a relatively small-sized apparatus configuration. Accordingly, it has been investigated to prepare recorded matters having metallic gloss surfaces by such an ink jet recording process. For example, JP-A-2011-137164 proposes a particle diameter of a glitter pigment for achieving both sufficient glitter of a recorded matter and stable discharge of ink from a minute nozzle of an ink jet head.

High gloss of an image formed on a recording medium is achieved by applying a glitter pigment uniformly and flatly onto the surface of the recording medium. For example, a glitter ink composition used in screen recording contains plate-like glitter pigment particles having an average particle diameter of 10 μm or more. An ink jet recording process is, however, required to use minute glitter pigment particles having an average particle diameter of about 0.5 to 5 μm for securing stable discharge from nozzles. Consequently, irregular overlapping, i.e., a deterioration in flatness, is caused in some cases due to the flatness of the surface of a recording medium itself to which the glitter pigment adheres. In some cases, the glitter pigment permeates into the depths of a recording medium depending on the permeability of the ink composition to the recording medium to reduce the pigment density on the surface of the recording medium. These phenomena lead to a disadvantage that a smooth and uniform reflective surface is not formed on the surfaces of recording media and sufficient glitter is achieved only on specific recording media. This disadvantage is particularly significant when plate-like particles are used.

SUMMARY

An advantage of some aspects of the invention is to solve at least a part of the disadvantage described above, and the invention can be realized as the following aspects or application examples.

APPLICATION EXAMPLE 1

The ink jet recording process according to this application example includes a glitter image-forming step of forming a glitter image by discharging a glitter ink composition containing a glitter pigment to a recording medium and a pressing step of pressing the layer of the glitter image formed on the recording medium.

In this application example, the pressing step of pressing the layer of the glitter image physically reduces the unevenness due to irregular overlapping of the glitter pigment particles on the surface of the recording medium and thereby increases the smoothness of the reflective surface of the glitter pigment to achieve satisfactory glitter.

APPLICATION EXAMPLE 2

In the ink jet recording process according to application example 1, the glitter pigment is preferably in a form of plate-like particles preferably having a 50% mean particle diameter R50 of 0.25 μm or more and 5.0 μm or less based on the equivalent circle diameters determined from the X-Y plane areas of the plate-like particles.

In this application example, the glitter pigment is in a form of plate-like particles, and the 50% mean particle diameter R50 based on the equivalent circle diameters determined from the X-Y plane areas of the plate-like particles is preferably 0.25 μm or more and 5.0 μm or less. Consequently, stable discharge by the ink jet head can be secured. In addition, the pressing step of pressing the layer of the glitter image physically reduces the unevenness by irregular overlapping of the glitter pigment particles on the surface of the recording medium compared to known analog recording ink even if the plate-like particles have a small average particle diameter. As a result, the smoothness of the reflective surface of the glitter pigment is increased to achieve satisfactory glitter.

APPLICATION EXAMPLE 3

In the ink jet recording process according to application example 1 or 2, the difference between the arithmetic mean roughnesses of the glitter image before and after the pressing step is preferably 1 μm or more.

In this application example, the glitter pigment particles arranged on the surface of the recording medium is sufficiently flattened by the pressing step, and the glitter of the resulting recorded matter can be thereby further enhanced.

APPLICATION EXAMPLE 4

In the ink jet recording process according to any one of application examples 1 to 3, the process preferably further includes, before the glitter image-forming step, a base layer-forming step of forming a base layer for the glitter image by applying a base ink composition containing base particles to the recording medium.

In this application example, the base layer previously formed can prevent permeation of the glitter pigment contained in the glitter ink composition applied (discharged) to the surface of the recording medium from the surface layer into the depths of the recording medium together with the solvent contained in the glitter ink composition. The pressing step simultaneously flattens both the base layer and the glitter image layer to further enhance the glitter of the resulting recorded matter.

APPLICATION EXAMPLE 5

In the ink jet recording process according to any one of application examples 1 to 4, the glitter ink composition preferably has a surface tension of 30 mN/m or less.

In this application example, the glitter ink composition has a surface tension of 30 mN/m or less to further enhance the gloss (glitter) of the glitter image. In particular, in formation of a glitter image on the base layer, the glitter ink composition having a surface tension of 30 mN/m or less shows sufficient wet spreading properties when it is applied onto the base layer. As a result, the recorded glitter image is flattened and has excellent gloss.

APPLICATION EXAMPLE 6

In the ink jet recording process according to application example 4 or 5, the glitter ink composition preferably has a surface tension lower than that of the base ink composition.

In this application example, the wet spreading properties of the glitter ink composition to the base layer is sufficient, and thereby the glitter image is further flattened and has excellent gloss (glitter).

APPLICATION EXAMPLE 7

In the ink jet recording process according to any one of application Examples 4 to 6, the process preferably further includes a pretreatment step of applying a pretreatment solution containing a coagulant that can agglomerate the base particles contained in the base ink composition or the glitter pigment particles to the recording medium before the base layer-forming step. Alternatively, the recording medium preferably contains the coagulant.

In this application example, the coagulant accelerates the agglomeration of the base particles forming the base layer for the glitter pigment or the agglomeration of the glitter pigment particles on the surface of the recording medium, which prevents the base particles or the glitter pigment from permeating into the depths of the recording medium. As a result, a reduction in concentration of the glitter pigment on the surface of the recording medium can be inhibited to further increase the glitter of the resulting recorded matter.

APPLICATION EXAMPLE 8

In the ink jet recording process according to any one of application examples 4 to 7, the base ink composition preferably contains water or an organic solvent, and the residual rate of the water or the organic solvent contained in the base ink composition when the glitter pigment is discharged in the glitter image-forming step is preferably 10% by mass or more and 80% by mass or less.

In this application example, the residual rate of the solvent component, i.e., water and an organic solvent, or water, or an organic solvent, in the base ink composition is 10% by mass or more and 80% by mass or less. In such a case, the base layer also shows fluidity in the pressing step. Consequently, the glitter of the resulting recorded matter can be further enhanced by pressing. If the residual rate of the solvent component, i.e., water and an organic solvent, or water, or an organic solvent, in the base ink composition is less than 10% by mass, the fluidity of the base layer during the pressing is low, and the recorded matter is not provided with sufficient glitter even if the applied glitter ink composition is pressed. If the residual rate is higher than 80% by mass, the base ink composition and the glitter ink composition are remarkably mixed with each other, and the recorded matter is not provided with sufficient glitter even if the applied glitter ink composition is pressed.

APPLICATION EXAMPLE 9

In the ink jet recording process according to any one of application examples 1 to 8, the process preferably includes, after the glitter image-forming step and the pressing step, a protective layer-forming step of forming a protective layer by applying a protective ink composition substantially not containing a coloring material onto at least part of the glitter image or a color image-forming step of forming a color image by applying a color ink composition containing a coloring material onto at least part of the glitter image.

In this application example, a recorded matter having satisfactory glitter is further provided with satisfactory scratch resistance and an improvement in design by color metallic glitter.

APPLICATION EXAMPLE 10

In the ink jet recording process according to any one of application examples 1 to 9, the recording medium is fabric.

In this application example, the glitter of the resulting recorded matter can be enhanced even if the recording medium has a surface having large unevenness, such as fabric.

APPLICATION EXAMPLE 11

In the ink jet recording process according to any one of application examples 1 to 10, the pressing step is preferably performed by pressing the recording medium provided with the glitter image under heating at a temperature of 40° C. or more and 250° C. or less.

In this application example, softening of the resin contained in the base layer or the glitter image layer by pressing the recording medium having a recorded glitter image under heating at a temperature of 40° C. or more and 250° C. or less can be utilized for further remarkably flattening the glitter image layer. Consequently, the glitter and the scratch resistance of the resulting recorded matter can be further enhanced.

APPLICATION EXAMPLE 12

In the ink jet recording process according to any one of application examples 1 to 11, the glitter image after the pressing step preferably has an arithmetic mean roughness (Ra2) of 10 μm or less.

In this application example, the recorded matter can be provided with higher glitter.

APPLICATION EXAMPLE 13

The recorded matter according to this application example is prepared by the ink jet recording process according to any one of application examples 1 to 12.

In this application example, a recorded matter having satisfactory glitter can be produced.

APPLICATION EXAMPLE 14

The ink jet recording apparatus according to this application example performs the ink jet recording process according to any one of application examples 1 to 12.

In this application example, a recorded matter having satisfactory glitter can be produced.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
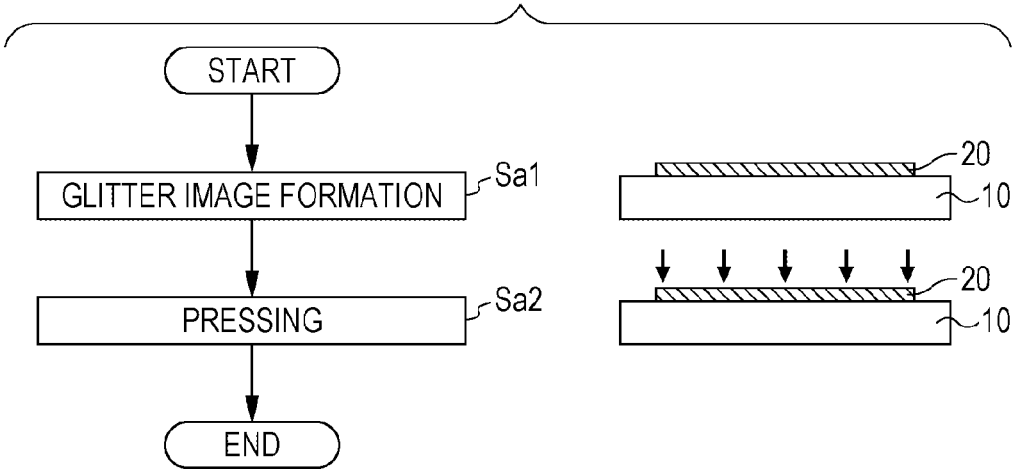
FIG. 1 is a flow diagram showing the ink jet recording process according to a first embodiment.

Preferred embodiments of the invention will now be described, but the invention is not limited thereto.

Ink Jet Recording System

An ink jet recording system refers to a recording system such as a system performing recording by applying a strong electric field between a nozzle and an acceleration electrode placed in front of the nozzle, continuously ejecting (discharging) ink droplets from the nozzle, and supplying recording information signals to deflection electrodes while the ink droplets are traveling between the deflection electrodes or by ejecting ink droplets corresponding to printing information signals without deflecting the ink droplets (electrostatic aspiration system); a system of forcefully ejecting ink droplets by applying a pressure to an ink solution with a small-sized pump and mechanically vibrating a nozzle with, for example, a quartz oscillator; a system performing recording by simultaneously applying a pressure and a printing information signal to an ink solution with a piezoelectric element and ejecting ink droplets (piezoelectric system); or a system performing recording by heating an ink solution with a microelectrode according to a recording information signal to form foam and ejecting ink droplets by means of the foam (thermal jetting system). The recording by the ink jet system is performed by an ink jet recording apparatus including, for example, a head of an ink jet system, a body, a tray, a head-driving mechanism, and a carriage.

Glitter Image

The glitter image according to the invention is an image having texture such as metallic or mica-like pearly gloss. The glitter refers to a property that is characterized by, for example, relative-specular glossiness (see Japanese Industrial Standards (JIS) Z8741) of the resulting image. The types of glitter include glitter of specularly reflecting light and glitter of mat tone. These types of glitter are each defined by the degree of relative-specular glossiness.

The glitter image can be formed by discharging a glitter ink composition containing a glitter pigment so as to adhere (to be recorded) to a recording medium by an ink jet recording system.

Glitter Ink Composition

The glitter ink composition may have any composition and is preferably composed of, for example, a glitter pigment, a main solvent of water or at least one organic solvent (e.g., polyol or glycol ether), a resin, and a surfactant.

Glitter Pigment

The glitter pigment may be any pigment that shows glitter in a state adhering to a medium. Examples of the glitter pigment include aluminum, silver, gold, platinum, nickel, chromium, tin, zinc, indium, titanium, and copper; alloys of at least two thereof (also referred to as metallic pigments); and pearl pigments having pearly gloss. Typical examples of the pearl pigments include pigments having pearly gloss or interference gloss such as titanium dioxide-coated mica, argentine foil, and bismuth acid chloride. The glitter pigment may be surface-treated for suppressing reaction with water, acids, and alkalis (e.g., water resistant aluminum pigment). An ink containing such a glitter pigment can form an image having excellent glitter.

Among the glitter pigments mentioned above, the metallic pigments can impart excellent metallic gloss to recorded images and are therefore preferred.

Water Resistant Metallic Pigment

The metallic pigment may be a water resistant metallic pigment. The film coating the water resistant metallic pigment may be composed of any material that can enhance water resistance. The coating film preferably contains an inorganic oxide formed from, for example, alkoxysilane (e.g., tetraethoxysilane) or polysilazane having a silicon atom in the structure or is preferably formed from a fluorine-containing material. In particular, from the viewpoint of capable of forming a uniform and flat film on the surfaces of metallic pigment particles, preferred is alkoxysilane. In particular, in a case of using an aluminum pigment of aluminum or an aluminum alloy, tetraethoxysilane, which can form a silica film having an excellent adhesion to aluminum pigments, is further preferred.

The coating film may be formed by any method. For example, the method described in U.S. Patent Publication No. 2010/0256284 or 2010/0256283 can be employed.

When the glitter pigment according to the invention is in a form of plate-like particles, the flat surfaces of the plate-like particles each have a major axis X, a minor axis Y, and a thickness Z satisfying the requirement that the 50% mean particle diameter R50 of equivalent circle diameters determined from the X-Y areas of the plate-like particles is 0.25 μm or more and 5.0 μm or less, more preferably 0.5 μm or more and 3.0 μm or less, and most preferably 0.75 μm or more and 2.0 μm or less.

The term "plate-like particle" refers to a particle having an approximately flat surface (X-Y plane) and an approximately uniform thickness (Z). Since the plate-like particles can be produced by pulverizing a metal evaporated film, metallic particles having an approximately flat surface and an approximately uniform thickness can be produced, and the major axis and the minor axis of the flat surface and the thickness of the plate-like particle can be denoted as X, Y, and Z, respectively.

The term "equivalent circle diameter" refers to the diameter of an assumed circle having the same projected area as that of the approximately flat surface (X-Y plane) of the plate-like particle of the glitter pigment. For example, when the approximately flat surface (X-Y plane) of the plate-like particle of the glitter pigment is a polygon, the diameter of a circle that is obtained by converting the projected image of the polygon so as to have the same area as that of the polygon is the equivalent circle diameter of the plate-like particle of the flitter pigment.

A 50% mean particle diameter R50 of smaller than 0.25 μm provides a small size of the completely flat gloss surface formed by a single pigment particle, which may reduce the glitter of the recorded matter. In addition, a 50% mean particle diameter R50 of smaller than 0.25 μm is technologically difficult to be achieved. A 50% mean particle diameter R50 of larger than 5.0 μm reduces stability of recording with an ink jet head having a minute nozzle diameter.

The relationship between the 50% mean particle diameter R50 of the equivalent circle diameters and the thickness Z preferably satisfies a requirement, R50/Z>5, from the viewpoint of securing high metallic gloss. If the R50/Z is 5 or less, the horizontality of the glitter pigment particles to the recording medium decreases when a plurality of glitter pigment layers are discontinuously stacked, resulting in insufficient glitter of the recorded matter. The thickness Z can be measured with a transmission electron microscope (TEM) such as JEM-2000EX manufactured by JEOL Ltd. or a scanning electron microscope such as a field emission scanning electron microscope (FE-SEM), S-4700, manufactured by Hitachi, Ltd. The thickness Z refers to an average thickness of those measured ten times.

The maximum particle diameter Rmax based on the equivalent circle diameters of the plate-like particles determined from the X-Y plane areas is preferably 10 μm or less from the viewpoint of preventing the ink composition from clogging in an ink jet recording apparatus. Clogging of, for example, the nozzle of an ink jet recording apparatus and the mesh filter disposed in an ink channel can be prevented by regulating the Rmax to 10 μm or less.

The major axis X, the minor axis Y, and the equivalent circle diameter of the flat surface of the glitter pigment particle (plate-like particle) can be measured with a particle image analyzer. Examples of the particle image analyzer include flow particle image analyzers, FPIA-2100, FPIA-3000, and FPIA-3000S, manufactured by Sysmex Corp. Measurement with FPIA-3000 or FPIA-3000S can be performed, for example, using a high-magnification imaging unit at an HPF measurement mode.

The particle size distribution (CV value) of glitter pigment particles (plate-like particles) can be determined by the following expression:

$$\text{CV value}=(\text{standard deviation of particle size distribution})/(\text{average particle diameter})\times 100$$

The resulting CV value is preferably 60 or less, more preferably 50 or less, and most preferably 40 or less. Glitter pigment particles showing a CV value of 60 or less can advantageously provide high recording stability.

The concentration of the glitter pigment in the glitter ink composition is preferably 0.1% to 5.0% by mass, more preferably 0.1% to 3.0% by mass, more preferably 0.25% to 2.5% by mass, and most preferably 0.5% to 2.0% by mass based on the total mass of the ink composition. Within a concentration of 0.1% to 5.0% by mass, the glitter pigment particles are smoothly arranged on a recording surface to provide sufficient gloss. In a concentration of the glitter pigment of less than 0.1% by mass, the glitter pigment cannot sufficiently cover a recording surface, resulting in insufficient gloss. In a concentration of higher than 5.0% by mass, the glitter pigment particles are randomly arranged on a recording surface, failing in provision of high gloss.

Water

The glitter ink composition may be an aqueous ink containing 25% by mass or more of water or may be a non-aqueous ink containing less than 25% by mass of water, and preferred is an aqueous ink containing 25% by mass or more of water, which enhances the fixability and the orientation, on a recording medium, of the glitter pigment by prompt reduction of the solvent on the recording medium.

Water contained in an ink mainly functions as a dispersant for dispersing a glitter pigment and resin emulsion. In an ink containing water, the dispersion stability of a glitter pigment and other components is high, and the ink applied onto a recording medium is rapidly dried while preventing undesirable drying of the ink (evaporation of dispersant) around the nozzle of, for example, a liquid droplet discharging apparatus described below. Consequently, high-speed recording of intended images can be satisfactorily performed over a long period of time. The content of water in an ink is not particularly limited and is preferably 10% by mass or more and 80% by mass or less and more preferably 25% by mass or more and 70% by mass or less.

Polyol

The glitter ink composition according to the invention preferably contains a polyol. When such an ink is applied to an ink jet recording apparatus, the polyol inhibits drying of the ink to prevent clogging of the ink jet recording head with the ink.

Examples of the polyol include ethylene glycol, diethylene glycol, triethylene glycol, polyethylene glycol, polypropylene glycol, propylene glycol, butylene glycol, 1,2,6-hexanetriol, thioglycol, hexylene glycol, glycerin, trimethylolethane, trimethylolpropane, 1,2-butanediol, 1,2-pentanediol, 1,2-hexanediol, 1,6-hexanediol, 1,2-heptanediol, and 1,2-octanediol. In particular, preferred are alkanediols having 4 to 8 carbon atoms, and more preferred are alkanediols having 6 to 8 carbon atoms. These alkanediols can provide particularly high permeability of an ink into recording media. The content of the polyol in an ink is preferably 0.1% by mass or more and 20% by mass or less and more preferably 0.5% by mass or more and 10% by mass or less, but is not limited thereto.

In particular, the ink preferably contains 1,2-hexanediol or trimethylolpropane. These polyols provide particularly excellent dispersion stability of glitter pigments in inks and increase the storage stability and also the discharge stability of inks.

Glycol Ether

The glitter ink composition according to the invention preferably contains a glycol ether. The glycol ether contained in an ink enhances the wettability of the ink to a recording surface such as a recording medium to enhance the permeability of the ink.

Examples of the glycol ether include lower alkyl ethers of polyols such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether. In particular, triethylene glycol monobutyl ether can provide satisfactory recording quality. The content of the glycol ether in an ink is preferably 0.2% by mass or more and 20% by mass or less and more preferably 0.3% by mass or more and 10% by mass or less, but is not limited thereto.

Resin

The glitter ink composition according to the invention preferably contains a resin. The ink containing a resin has high fixability and scratch resistance. Examples of the resin include, but not limited to, polyacrylic acid, polymethacrylic acid, polymethacrylate, polyethylacrylate, styrene-butadiene copolymers, polybutadiene, acrylonitrile-butadiene copolymers, chloroprene copolymers, fluororesins, vinylidene fluoride, polyolefin resins, cellulose, styrene-acrylic acid copolymers, styrene-methacrylic acid copolymers, polystyrene, styrene-acrylamide copolymers, polyisobutyl acrylate, polyacrylonitrile, polyvinyl acetate, polyvinyl acetal, polyvinylpyrrolidone, polyamide, rosin resins, fluorene resins, polyethylene, polycarbonate, vinylidene chloride resins, cellulose resins such as cellulose acetate butyrate, vinyl acetate resins, ethylene-vinyl acetate copolymers, vinyl acetate-acrylic copolymers, vinyl chloride resins, polyurethane, and rosin esters.

Surfactant

The glitter ink composition according to the invention preferably contains a surfactant. The surfactant may be of any type and is preferably an acetylene glycol surfactant, polysiloxane surfactant, or fluorosurfactant. The acetylene glycol surfactant, polysiloxane surfactant, and fluorosurfactant enhance the wettability of the ink to a recording surface such as a recording medium to enhance the permeability of the ink.

Examples of the acetylene glycol surfactant include 2,4,7,9-tetramethyl-5-decine-4,7-diol, 3,6-dimethyl-4-octine-3,6-diol, and 3,5-dimethyl-1-hexin-3-ol, 2,4-dimethyl-5-hexin-3-ol. The acetylene glycol surfactant may be a commercially available one, such as Olfine series E1010, STG, and Y (these are products of Nissin Chemical Industry, Co., Ltd.) or Surfynol series 104, 82, 465, 485, and TG (these are products of Air Products and Chemicals Inc.).

The polysiloxane surfactant may be commercially available one, such as BYK-347 and BYK-348 (manufactured by BYK-Chemie Japan, Inc.).

The fluorosurfactant may be commercially available one, such as Megafac series F479 and F553 (manufactured by DIC Corporation) and BYK-340 (manufactured by BYK-Chemie Japan, Inc.).

The ink according to the invention can also contain another surfactant such as an anionic surfactant, nonionic surfactant, or amphoteric surfactant.

The content of the surfactant in the ink is preferably 0.01% by mass or more and 5.0% by mass or less and more preferably 0.1% by mass or more and 0.5% by mass or less, but is not limited thereto.

Other Components

The glitter ink composition according to the invention may contain components (other components), in addition to the above-described components. Such components are, for example, a pH adjuster, a penetrant, an organic binder, a urea compound, a saccharide, a dry inhibitor such as an alkanolamine (e.g., triethanolamine), and a glitter layer slippage-imparting agent such as paraffin.

Physical Properties of Ink

The glitter ink composition appropriately containing the components described above preferably has a viscosity V (Pa·s) within a range of $1.5 \leq V \leq 10$ and more preferably $2.5 \leq V \leq 8$. Within such a range, the image formed from the glitter ink composition can have excellent gloss (glitter) and high scratch resistance. In addition, the discharge stability (e.g., the precision in landing position and uniformity in discharge amount) of the ink in an ink jet system is increased to certainly form an image maintaining an intended quality over a long time.

The glitter ink composition preferably has a surface tension $S_1$ (mN/m) of $S_1 \leq 40$, more preferably $S_1 \leq 30$, more preferably $20 \leq S_1 \leq 30$, and most preferably $20 \leq S_1 \leq 25$. A surface tension of the glitter ink composition of 40 mN/m or less provides satisfactory gloss (glitter) to glitter images.

In particular, in a glitter image formed on a base layer from a glitter ink composition having a surface tension of 30 mN/m or less, the recorded glitter image is flattened due to the sufficient wet spreading properties of the glitter ink composition adhered onto the base layer and thereby has excellent gloss. A surface tension of 20 mN/m or more can prevent the glitter ink composition from permeating into the base layer to record a further flattened glitter image having excellent gloss.

In formation of a color image on a glitter image, if the glitter ink composition has a surface tension of 30 mN/m or less, the color ink composition can show high wettability to the glitter image. In addition, a surface tension of the glitter ink composition of 20 mN/m or more can inhibit bleeding of the color ink composition. Thus, a surface tension $S_1$ of $20 \leq S_1 \leq 30$ gives good balance between wettability and bleeding of the color ink composition and can form a color image (color metallic image) with good quality.

In formation of a base layer on a recording medium, the surface tension $S_2$ of a base ink composition for forming the base layer and the surface tension $S_1$ of the glitter ink composition is preferably $S_1 < S_2$, more preferably $0 < S_2 - S_1 < 5$, and most preferably $1 < S_2 - S_1 < 5$. A relationship $S_1 < S_2$, i.e., when the surface tension of the glitter ink composition is higher than the surface tension of the base ink composition, the glitter ink composition can have good wettability to the base layer to record a further flattened glitter image having excellent gloss (glitter). A relationship $S_2 - S_1 < 5$ can inhibit excessive permeation of the glitter ink composition into the base layer to record a further flattened glitter image having excellent gloss.

In formation of a base layer in a region containing a coagulant, the unevenness of the surface of the base layer is increased by the agglomerated base particles to reduce the flatness of the base layer, which may lead to insufficient spread of the glitter ink composition applied onto the base layer and may reduce the gloss of the glitter image. Even if the coagulant reduces the flatness of the base layer, the wettability of the glitter ink composition can be increased by controlling the surface tension of the glitter ink composition within the above-mentioned range or controlling the relationship between the surface tensions of the glitter ink composition and the base ink composition as described above. Consequently, a reduction in the gloss of the glitter image can be inhibited.

Throughout the specification, the "surface tension" and "viscosity" refer to the values measured at an ink temperature of 23° C. unless specifically noted otherwise. The surface tension can be measured by a Wilhelmy method (plate method) with a Wilhelmy surface tension balance such as "automatic surface tension balance CBVP-Z" manufactured by Kyowa Interface Science Co., Ltd. The viscosity can be measured with a vibration-type viscometer such as "vibration-type viscometer VM-100A". The vibration-type viscometer can calculate the viscosity of a solution from the torque amount for maintaining the vibration of an oscillator immersed in the solution constant.

Recording Medium

The invention can use any recording medium. For example, a variety of recording media such as plain paper, paper exclusive for ink jet recording (mat printing paper, glossy printing paper), plastic films such as vinyl chloride sheets, and films including substrates coated with a plastic or receiving layer can be used. In particular, the invention is effective for fabric having large surface roughness. Any fabric including cloth and woven fabric, which are difficult to form images having metallic gloss thereon, can be used. Throughout the specification, the term "fabric" refers to, for example, cloth, woven fabric, or non-woven fabric and is made from natural fibers, synthetic fibers, or mixed spun fibers. Specific examples of such fabric include "1005 fabric" defined in Japanese Industrial Standards (JIS) L0206 (1999) and fabric described in the section "3.3 Denotation of fabric" in the JIS.

In a method of attaching and transferring metal foil to a recording medium, if the recording medium is fabric (e.g., T-shirt), the adhesive solution permeates into the fabric, leading to a difficulty in satisfactory transfer of the metal foil. Even in an image formed through ejection of a glitter ink to fabric by an ink jet system, if any after treatment is not performed, satisfactory glitter cannot be obtained because of the large surface roughness (unevenness) and unsmooth layer due to the resin component of the ink.

Accordingly, improvements in the method and conditions for forming a glitter image by discharging a glitter ink composition containing a glitter pigment to a recording medium have been performed as in the ink jet recording process described below.

Ink Jet Recording Process

The ink jet recording process of the invention records an image having glitter with an ink jet recording apparatus and includes an image-forming step of forming a glitter image by discharging a glitter pigment to a recording medium and a pressing step of pressing the formed glitter image layer. The process more preferably includes, prior to the image-forming step, a base layer-forming step of forming a base layer of particles serving as a base for the glitter image. The process more preferably includes a pretreatment step of applying a pretreatment solution to the recording medium that is used in the base layer-forming step.

The residual rate of the solvent component composed of water and an organic solvent (or water or an organic solvent) contained in the base ink composition when the glitter pigment is discharged in the glitter image-forming step is preferably 10% by mass or more and 80% by mass or less. The pressing step is more preferably performed by pressing the recording medium provided with a glitter image under heating at 40° C. to 250° C. (more preferably 50° C. to 200° C.).

The ink jet recording process of the invention will be specifically described by the following embodiments.

First Embodiment

The ink jet recording process according to this embodiment includes a glitter image-forming step of forming a glitter image by discharging a glitter ink composition containing a glitter pigment to a recording medium and a pressing step of pressing the layer of the glitter image formed on the recording medium.

FIG. 1 is a flow diagram showing the ink jet recording process according to a first embodiment and includes schematic cross-sectional views of fabric 10 (e.g., T-shirt cloth) as a recording medium in each step. The ink jet recording process of the first embodiment will now be described with reference to the drawings.

Glitter Image-Forming Step

A glitter ink composition described above is prepared. In the glitter image-forming step, a glitter image layer 20 is formed by discharging the glitter ink composition to an image-forming region of the fabric 10 from, for example, the head of an ink jet recording apparatus described below (Step Sa1).

Pressing Step

In the pressing step, the fabric 10 provided with the glitter image layer 20 on the surface is heated and pressed (Step Sa2). Specifically, for example, the fabric 10 is placed on a supporting table of a pressing unit of the ink jet recording apparatus described below, and a heating plate of the pressing unit is pressed toward the supporting table to heat and press the fabric 10 lying between the heating plate and the supporting table (heat press system). The heating temperature is preferably 40° C. or more and 250° C. or less. On this occasion, it is preferable to place, for example, a heat resistant sheet coated with, for example, silicon or polytetrafluoroethylene on the fabric 10 and to heat and press the fabric 10 through the heat resistant sheet. The heating temperature refers to the temperature of the surface of the pressing unit being in contact with the recording medium.

Specific pressing specifications (e.g., temperature, time, and pressure) are appropriately determined depending on the quality and surface conditions of the recording medium (fabric 10) and the components of the glitter ink composition. That is, since the surface roughness of a glitter image varies depending on the pressing specifications, the conditions are set such that the following arithmetic mean roughness (Ra) is achieved.

The pressing specifications are set such that the difference between the arithmetic mean roughness (Ra1) of a glitter image before the pressing step and the arithmetic mean roughness (Ra2) of the glitter image after the pressing step is 1 μm or more, more preferably 2 μm or more, and most preferably 3 μm or more. The arithmetic mean roughness (Ra2) of a glitter image after the pressing roughness is preferably 10 μm or less and more preferably 8 μm or less.

Arithmetic Mean Roughness (Ra)

Arithmetic mean roughness (Ra) based on JIS B 0601-2001 can be measured with a profiling laser microscope, such as an ultra-depth color 3D profiling microscope (VK-9500 (controller unit)/VK-9510 (measurement unit), Keyence Corporation).

In the ink jet recording process according to this embodiment, softening of the resin contained in the glitter image layer 20 by pressing the recording medium having a recorded glitter image under heating at a temperature of 40° C. to 250° C. can be utilized for further remarkably flattening the glitter image layer 20. Consequently, the glitter of the resulting recorded matter can be further enhanced. That is, since the glitter pigment secures stable discharging by an ink jet head, the pressing step physically reduces the unevenness by irregular overlapping of the glitter pigment particles on the surface of the recording medium (fabric 10) even if the plate-like particles have a smaller average particle diameter than known analog recording ink. As a result, the smoothness of the reflective surface by the glitter pigment particles is increased to provide satisfactory glitter.

Second Embodiment

The ink jet recording process according to this embodiment further includes, prior to the glitter image-forming step in the ink jet recording process according to the first embodiment, a base layer-forming step of forming a base layer for the glitter image through application of a base ink composition containing base particles.

The residual rate of the solvent component composed of water and an organic solvent (or water or an organic solvent) contained in the base ink composition when the glitter pigment is discharged in the glitter image-forming step is 10% by mass or more and 80% by mass or less. The base ink may be applied by discharging from an ink jet head or may be direct application with, for example, an analog coater.

Base Ink Composition

In this embodiment, a base ink composition containing base particles for forming a base layer is used. The base ink composition is not particularly limited and is preferably a white ink composition. The base particles are preferably those of a white pigment.

The term "white ink composition" refers to an ink that can record an image having a color called "white" under social standards and may be slightly colored. Inks containing pigments sold by a name of "white ink" are also included. In addition, for example, in recording with an ink on Epson genuine photographic paper, Gloss, (manufactured by Seiko Epson Corporation) at a duty of 100% or more or recording with the ink such that photographic paper is sufficiently covered with the ink, the brightness (L*) and the chromaticity (a*, b*) of the ink are within the ranges of $70 \leq L^* \leq 100$, $-4.5 \leq a^* \leq 2$, and $-6 \leq b^* \leq 2.5$ when measured with a spectrophotemeter Spectrolino (trade name, manufactured by GretagMacbeth) under measurement conditions set to light source: D50, field of view: 2°, concentration: DIN NB, white standard: Abs, filter: No, and measurement mode: Reflectance, such inks are also included in the white ink composition.

The white ink composition is preferably composed of a white pigment, a solvent being water or at least one organic solvent, a resin, a surfactant, and other components. Each component of the white ink composition will now be described, but the solvent, resin, surfactant, and other some components are the same as those described in the paragraph of the glitter ink composition, and the explanation thereof is omitted.

The duty is calculated by the following expression:

$$\text{Duty (\%)} = (\text{actual number of dots printed})/[(\text{vertical resolution}) \times (\text{horizontal resolution})] \times 100$$

In the expression, the term "actual number of dots printed" refers to the actual number of dots printed per unit length; and the terms "vertical resolution" and "horizontal resolution" each refer to the resolution per unit length.

White Pigment

Examples of the white pigment include metal oxides, barium sulfate, calcium carbonate, and hollow resin particles. Examples of the metal oxide include titanium dioxide, zinc oxide, silica, alumina, and magnesium oxide. In particular, titanium dioxide is preferred because of its excellent whiteness.

Particles of the white pigment may have any average particle diameter. For example, the average particle diameter is preferably 100 to 1000 nm, more preferably 200 to 500 nm, and most preferably 300 to 400 nm. Within this range, a recorded matter can have excellent whiteness.

The term "average particle diameter" of the white pigment particles refers to a volume-based cumulative 50% particle diameter and is measured by light scattering with, for example, Microtrac UPA150 (Microtrac Inc.).

The content of the white pigment is preferably 3% to 30% by mass and more preferably 5% to 15% by mass based on the total mass of the white ink composition. Within this range, a recorded matter can have excellent whiteness.

The white ink composition can be prepared with a known apparatus, such as a ball mill, a sand mill, an attritor, a basket mill, or a roll mill, as in preparation of known pigment inks. In the preparation, coarse particles are preferably removed with a membrane filter or a mesh filter.

Residual Rate of Solvent Component

The residual rate of the solvent component composed of water and an organic solvent (or water or an organic solvent) contained in the base ink composition when the glitter pigment is discharged in the glitter image-forming step is calculated by dividing the mass of the solvent component composed of water and the organic solvent (or water or the organic solvent) contained in the base ink composition at the time of forming a glitter image by the mass of the solvent component composed of water and the organic solvent (or water or the organic solvent) contained in the base ink composition at the time forming a base layer. For example, a base layer is formed and is dried under a predetermined drying condition. A state that all the solvent component has volatilized corresponds to a residual rate of the solvent component of 0% by mass, whereas a state that water and an organic solvent (or water or an organic solvent) contained in the base ink composition at the time of forming a base layer has not volatilized at all at the time of forming a glitter image corresponds to a residual rate of the solvent component of 100% by mass.

Figure 2:
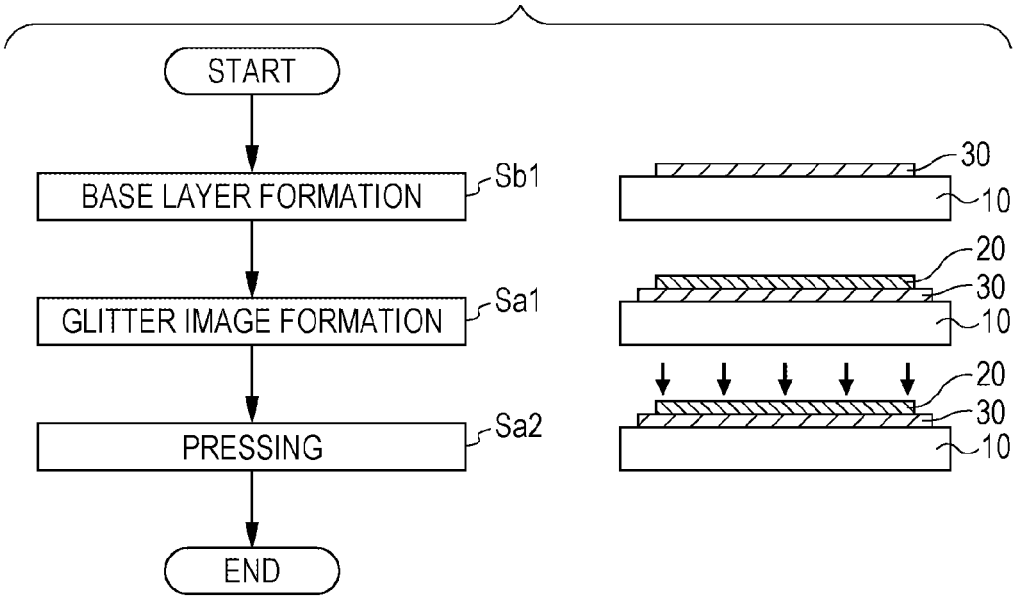
FIG. 2 is a flow diagram showing the ink jet recording process according to a second embodiment.

FIG. 2 is a flow diagram showing the ink jet recording process according to a second embodiment and includes schematic cross-sectional views of fabric 10 (e.g., T-shirt cloth) as a recording medium in each step. The ink jet recording process of the second embodiment will now be described with reference to the drawings.

Base Layer-Forming Step

A base layer 30 is formed on fabric 10 by discharging the above-described base ink composition from the head of an ink jet recording apparatus such that the base ink composition adheres to a predetermined range at a high duty (e.g., 400%) (Step Sb1).

The residual rate of the solvent component contained in the base ink composition when a glitter pigment is discharged in the glitter image-forming step is adjusted to 10% by mass to 80% by mass. Specifically, since the degree of volatility varies depending on the solvent used, the environment (e.g., temperature, humidity, and exposure time) after the application of the base ink composition is adjusted so as to provide such a residual rate.

Glitter Image Layer-Forming Step

Subsequently, as in the first embodiment, a glitter image layer 20 is formed by discharging a glitter ink composition to an image-forming region of the fabric 10 from the head of an ink jet recording apparatus described below (Step Sa1).

In the drawings, the base layer 30 and the glitter image layer 20 are clearly distinguished from each other, but actual layers are not necessarily distinguished clearly from each other. For example, if a glitter ink composition adhered to the base layer 30 before sufficient drying of the white ink composition forming the base layer 30, the white ink composition and the glitter ink composition may partially mixed with each other.

Pressing Step

Subsequently, as in the first embodiment, the fabric 10 provided with the glitter image layer 20 on the surface is heated and pressed (Step Sa2). As a result, a recorded matter is prepared.

In the ink jet recording process according to this embodiment, the base layer 30 previously formed can prevent permeation of the glitter pigment contained in the glitter ink composition applied to the surface of the recording medium (fabric 10), from the surface layer to the depths of the recording medium, together with water or at least one organic solvent contained in the glitter ink composition. In addition, the pressing step simultaneously flattens both the base layer 30 and the glitter image layer 20 to further enhance the glitter of the resulting recorded matter.

The base layer 30 in the pressing step also has a certain fluidity by controlling the residual rate of the solvent component composed of water and an organic solvent (or water or an organic solvent) in the base ink composition to 10% by mass or more and 80% by mass or less. Consequently, the glitter of the resulting recorded matter can be further enhanced by pressing. If the residual rate of the solvent component composed of water and an organic solvent (or water or an organic solvent) in the base ink composition is less than 10% by mass, since the base fluidity during pressing is low, the recorded matter is hardly provided with sufficient glitter even if the recorded glitter ink composition is pressed. If the residual rate is higher than 80% by mass, since the base ink composition and the glitter ink composition are remarkably mixed with each other, the recorded matter is hardly provided with sufficient glitter even if the recorded glitter ink composition is pressed.

Third Embodiment

The ink jet recording process according to this embodiment further includes, prior to the base layer-forming step in the ink jet recording process according to the second embodiment, a pretreatment step of applying a pretreatment solution containing a coagulant that can agglomerate the glitter pigment or base particles to the recording medium (fabric 10).

The coagulant preferably has an effect of agglomerating the base particles better than the glitter pigment. Even if the glitter pigment is agglomerated by the action of the coagulant, the agglomerated glitter pigment is flattened by the pressing step to give a glitter image having satisfactory glitter.

Pretreatment Solution

The pretreatment solution contains a coagulant and optionally contains water or an organic solvent. Examples of the organic solvent include those exemplified as those for the ink composition.

The "coagulant" has an effect of agglomerating the base particles contained in the base ink composition or the glitter pigment particles. The pretreatment solution preferably contains at least one coagulant selected from multivalent metal salts, organic acids, cationic resins, and cationic surfactants.

Examples of the multivalent metal salt contained in the pretreatment solution include salts of alkali earth metals such as Ca and Mg, specifically, $CaCl_2$, $Ca(NO_3)_2$, $Ca(OH)_2$, $(CH_2COO)_2Ca$, $MgCl_2$, $Mg(OH)_2$, and $(CH_2COO)_2Mg$. Particularly preferred are salts of Ca. Examples of the organic acid contained in the pretreatment solution include acetic acid, citric acid, propionic acid, and lactic acid. Particularly preferred is acetic acid. The pretreatment solution may contain any amount of a multivalent metal salt or an organic acid and, for example, about 0.1% to 40% by mass of the pretreatment solution. The pretreatment solution may contain any cationic resin. Resins including quaternary amines show high effects even in a small amount and are therefore preferred. The resins preferably contain nitrogen-containing cations or metal-containing cations as the groups imparting cationic properties to the resins. Examples of such cations include polyallylamines, polyamines, cation-modified acrylic resins, cation-modified methacrylic resins, cation-modified vinyl resins, cationic urethane resins, and copolymers thereof. Examples of the cationic surfactant contained in the pretreatment solution include primary, secondary, and tertiary amine compounds, alkyl amine salts, dialkyl amine salts, aliphatic amine salts, benzalkonium salts, quaternary ammonium salts, quaternary alkylammonium salts, alkylpyridinium salts, sulfonium salts, phosphonium salts, onium salts, and imidazolium salts. Specific examples of the cationic surfactant contained in the pretreatment solution include hydrochlorides, acetates, and other salts of, for example, laurylamine, palm amine, and rosin amine, such as lauryltrimethylammonium chloride, cetyltrimethylammonium chloride, benzyltributylammonium chloride, benzalkonium chloride, dimethylethyllaurylammoniumethyl sulfate, dimethylethyloctylammoniumethyl sulfate, trimethyllaurylammonium hydrochloride, cetylpyridinium chloride, cetylpyridinium bromide, dihydroxycetyllaurylamine, decyldimethylbenzylammonium chloride, dodecyldimethylbenzylammonium chloride, tetradecyldimethylammonium chloride, hexadecyldimethylammonium chloride, and octadecyldimethylammonium chloride.

The pretreatment solution may further contain a resin having a glass transition temperature of 0° C. or less, which leads to formation of an ink jet recorded matter having high friction solidity and flexibility. This resin may be any resin that does not agglomerate or precipitate when it is mixed with a metal salt.

Figure 3:
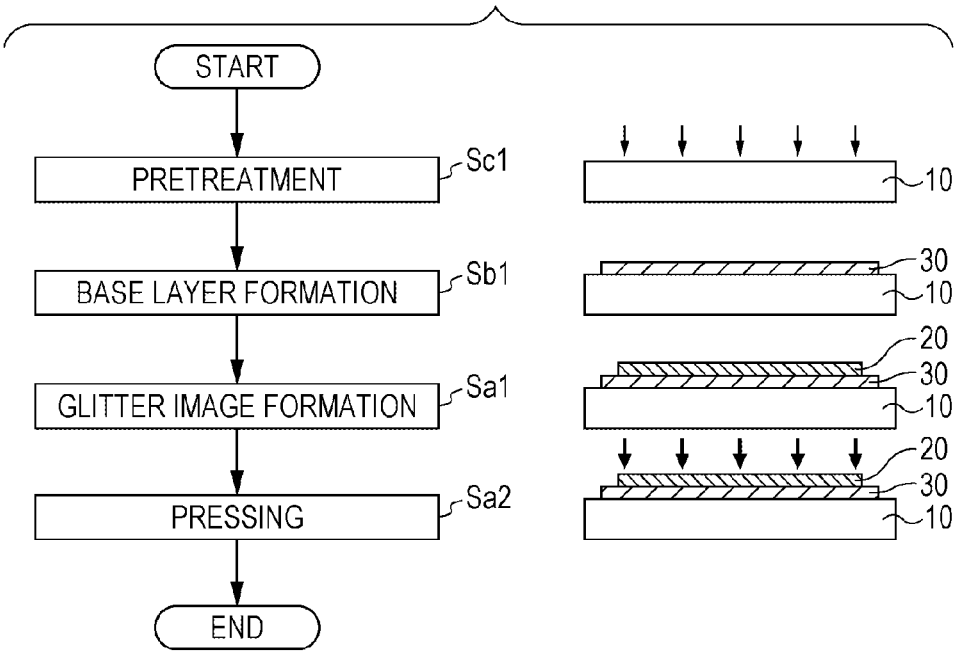
FIG. 3 is a flow diagram showing the ink jet recording process according to a third embodiment.

FIG. 3 is a flow diagram showing the ink jet recording process according to a third embodiment and includes schematic cross-sectional views of fabric 10 (e.g., T-shirt cloth) as a recording medium in each step. The ink jet recording process of the third embodiment will now be described with reference to the drawings.

Pretreatment Step

The pretreatment solution is applied to the image-forming region of the fabric 10. The pretreatment solution may be applied by any known method such as coating, spraying, or ink jet recording. The pretreatment solution applied to the fabric 10 is dried to complete the pretreatment step (Step Sc1).

Base Layer-Forming Step

Subsequently, as in the second embodiment, a base ink composition is sprayed to the fabric 10 to form a white base layer 30 on the fabric 10 (Step Sb1).

Glitter Image-Forming Step

Subsequently, as in the second embodiment, a glitter ink composition is discharged to the image-forming region of the fabric 10 to form a glitter image layer 20 (Step Sa1).

Pressing Step

Subsequently, as in the second embodiment, the fabric 10 provided with the glitter image layer 20 on the surface is heated and pressed (Step Sa2). As a result, a recorded matter is prepared.

In the ink jet recording process according to this embodiment, the base particles forming the base layer 30 for the glitter pigment or the glitter pigment particles promptly agglomerate on the surface of the recording medium (fabric 10) by the coagulant, which prevents the base particles forming the base layer 30 or the glitter pigment particles from permeating into the depths of the recording medium (fabric 10). As a result, a reduction in concentration of the glitter pigment on the surface of the recording medium can be inhibited to further increase the glitter of the resulting recorded matter.

In this embodiment, a pretreatment step for applying a pretreatment solution containing a coagulant having agglomeration activity to a recording medium is performed prior to the base layer-forming step. Alternatively, a recording medium may contain a coagulant showing agglomeration activity to the glitter pigment particles instead of performing the pretreatment.

Fourth Embodiment

The ink jet recording process according to this embodiment further includes, after the glitter image-forming step and the pressing step, a protective layer-forming step of forming a protective layer by discharging a protective ink composition substantially not containing a coloring material onto at least part of the glitter image or a color image-forming step of forming a color image by discharging a color ink composition containing a coloring material onto at least part of the glitter image.

Figure 4:
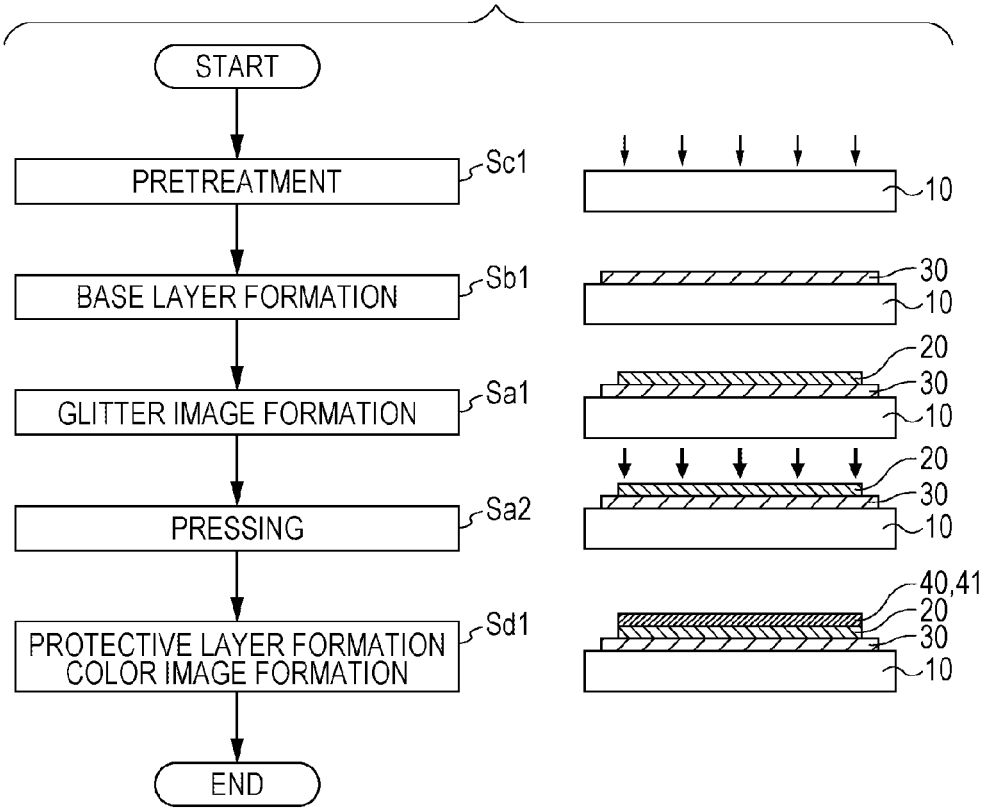
FIG. 4 is a flow diagram showing the ink jet recording process according to a fourth embodiment.

FIG. 4 is a flow diagram showing the ink jet recording process according to a fourth embodiment and includes schematic cross-sectional views of fabric 10 (e.g., T-shirt cloth) as a recording medium in each step. The ink jet recording process of the fourth embodiment will now be described with reference to the drawings.

Pretreatment Step

As in the third embodiment, a pretreatment solution containing a polyvalent metal salt is applied to the image-forming region of a fabric 10 and is dried (Step Sc1).

Base Layer-Forming Step

Subsequently, as in the second embodiment, a base ink composition is sprayed to the fabric 10 to form a white base layer 30 on the fabric 10 (Step Sb1).

Glitter Image-Forming Step

Subsequently, as in the second embodiment, a glitter ink composition is discharged to the image-forming region of the fabric 10 to form a glitter image layer 20 (Step Sa1).

Pressing Step

Subsequently, as in the second embodiment, the fabric 10 provided with the glitter image layer 20 on the surface is heated and pressed (Step Sa2).

Protective Layer-Forming Step and Color Image-Forming Step

Subsequently, a protective layer 40 is formed on at least part of the glitter image layer 20 by discharging a protective ink composition described below from the head of the ink jet recording apparatus. Alternatively, a color image layer 41 is formed on at least part of the glitter image layer 20 by discharging a color ink composition described below from the head of the ink jet recording apparatus (Step Sd1). As a result, a recorded matter is prepared.

In this embodiment, the protective layer-forming step may be performed after the color image-forming step. In such a case, the color image is protected by the protective layer to improve the physical strength such as scratch resistance of the color image.

Protective Ink Composition

The protective ink composition is an ink substantially not containing a coloring material and containing a resin having an average particle diameter of 200 nm or less and substantially not having a coloring effect. The protective ink composition may be an aqueous ink (water content: 25% or more) or a non-aqueous ink (water content: less than 25%). The "substantially not containing a coloring material" means that the content of the coloring material in an ink is less than 0.5% by mass and more preferably less than 0.1% by mass for example. The "coloring material" refers to a pigment or a dye that is used for coloring.

Resin Contained in Protective Ink Composition

The protective ink composition may contain a resin such as those exemplified as the resin contained in the glitter ink composition. The resin is preferably an acrylic, polyurethane, or fluorene resin. In particular, polyurethane and fluorene resins are preferred from the viewpoint of light resistance, and polyurethane resins are most preferred from the viewpoint of gloss after adhesion of the protective ink composition. The protective ink composition containing the resin component can impart excellent light resistance to a glitter image. The content of the resin in the protective ink composition is preferably within a range of 0.1% by mass or more and 30% by mass or less, more preferably 0.5% by mass or more and 15% by mass or less, on the basis of solid content.

Polyol Contained in Protective Ink Composition

The protective ink composition may contain a polyol such as those exemplified as the polyol contained in the glitter ink composition. In an ink according to the invention applied to an ink jet recording apparatus, the polyol inhibits drying of the ink to prevent clogging of the ink jet recording head with the ink.

Glycol Ether Contained in Protective Ink Composition

The protective ink composition may contain a glycol ether such as those exemplified as the glycol contained in the glitter ink composition. The glycol ether contained in an ink enhances the wettability of the ink to a recording surface such as a recording medium to enhance the permeability of the ink. The content of the glycol ether in an ink is not particularly limited and is preferably 0.2% by mass or more and 20% by mass or less and more preferably 0.3% by mass or more and 10% by mass or less.

Surfactant Contained in Protective Ink Composition

The protective ink composition preferably contains a surfactant such as acetylene glycol surfactant, polysiloxane surfactant, or fluorosurfactant. The surfactant may be any type. Typical examples of the acetylene glycol surfactant, polysiloxane surfactant, and fluorosurfactant are the same as those exemplified as the surfactant contained in the glitter ink composition. The acetylene glycol surfactant, polysiloxane surfactant, and fluorosurfactant enhance the wettability of the ink to a recording surface such as a recording medium to enhance the permeability of the ink. The content of surfactant in an ink is not particularly limited and is preferably 0.01% by mass or more and 5.0% by mass or less and more preferably 0.1% by mass or more and 0.5% by mass or less.

Other Components Contained in Protective Ink Composition

The protective ink composition may contain components (other components), in addition to the above-described components. Such components are, for example, a pH adjuster, a penetrant, an organic binder, a urea compound, a saccharide, a dry inhibitor such as an alkanolamine (e.g., triethanolamine), and a slippage-imparting agent such as paraffin.

Color Ink Composition

The color ink composition is an ink containing a coloring material. The color ink composition may be an aqueous ink (water content: 25% or more) or a non-aqueous ink (water content: less than 25%). Examples of the coloring material contained in the color ink composition include dyes and pigments.

Resin Contained in Color Ink Composition

The color ink composition may contain a resin such as those exemplified as the resin contained in the glitter ink composition. The color ink composition containing a resin component can provide strong scratch resistance. The content of the resin contained in the color ink composition is preferably within a range of 4% by mass or more and 50% by mass or less, more preferably 6% by mass or more and 25% by mass or less, on the basis of solid content.

Pigment as Coloring Material Contained in Color Ink Composition

Any pigment can be used as the coloring material. Examples of the pigment include inorganic pigments and organic pigments.

Usable examples of the "inorganic pigment" include carbon blacks (C.I. Pigment Black 7), such as furnace black, lamp black, acetylene black, and channel black; iron oxide; and titanium oxide.

Examples of the "organic pigment" include azo pigments, such as insoluble azo pigments, condensed azo pigments, azo lake, and chelate azo pigments; polycyclic pigments, such as phthalocyanine pigments, perylene and perinone pigments, anthraquinone pigments, quinacridone pigments, dioxane pigments, thioindigo pigments, isoindolinone pigments, and quinophthalone pigments; dye chelates (e.g., basic dye chelates and acid dye chelates); dye lakes (e.g., basic dye lakes and acid dye lakes); and nitro pigments, nitroso pigments, aniline black, and daylight fluorescent pigments. These pigments may be used alone or in combination. Specific examples of the pigment are shown below.

Examples of yellow organic pigments include C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of magenta organic pigments include C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245; and C.I. Pigment Violet 19, 23, 32, 33, 36, 38, 43, and 50.

Examples of cyan organic pigments include C.I. Pigment Blue 1, 2, 3, 15, 15:1, 15:2, 15:3, 15:4, 15:6, 15:34, 16, 18, 22, 25, 60, 65, and 66; and C.I. Vat Blue 4 and 60.

Dye as Coloring Material Contained in Color Ink Composition

As the dye, a variety of dyes that are usually used in ink jet recording, such as direct dyes, acid dyes, edible dyes, basic dyes, reactive dyes, disperse dyes, vat dyes, soluble vat dyes, and reactive disperse dyes, can be used. Specific examples of the dye are shown below.

Examples of yellow dyes include C.I. Acid Yellow 1, 3, 11, 17, 19, 23, 25, 29, 36, 38, 40, 42, 44, 49, 59, 61, 70, 72, 75, 76, 78, 79, 98, 99, 110, 111, 127, 131, 135, 142, 162, 164, and 165; C.I. Direct Yellow 1, 8, 11, 12, 24, 26, 27, 33, 39, 44, 50, 58, 85, 86, 87, 88, 89, 98, 110, 132, 142, and 144; C.I. Reactive Yellow 1, 2, 3, 4, 6, 7, 11, 12, 13, 14, 15, 16, 17, 18, 22, 23, 24, 25, 26, 27, 37, and 42; C.I. Food Yellow 3 and 4; and C.I. Solvent Yellow 15, 19, 21, 30, and 109.

Examples of magenta dyes include C.I. Acid Red 1, 6, 8, 9, 13, 14, 18, 26, 27, 32, 35, 37, 42, 51, 52, 57, 75, 77, 80, 82, 85, 87, 88, 89, 92, 94, 97, 106, 111, 114, 115, 117, 118, 119, 129, 130, 131, 133, 134, 138, 143, 145, 154, 155, 158, 168, 180, 183, 184, 186, 194, 198, 209, 211, 215, 219, 249, 252, 254, 262, 265, 274, 282, 289, 303, 317, 320, 321, and 322; C.I. Direct Red 1, 2, 4, 9, 11, 13, 17, 20, 23, 24, 28, 31, 33, 37, 39, 44, 46, 62, 63, 75, 79, 80, 81, 83, 84, 89, 95, 99, 113, 197, 201, 218, 220, 224, 225, 226, 227, 228, 229, 230, and 231; C.I. Reactive Red 1, 2, 3, 4, 5, 6, 7, 8, 11, 12, 13, 15, 16, 17, 19, 20, 21, 22, 23, 24, 28, 29, 31, 32, 33, 34, 35, 36, 37, 38, 39, 40, 41, 42, 43, 45, 46, 49, 50, 58, 59, 63, and 64; C.I. Solubilized Red 1; and C.I. Food Red 7, 9, and 14.

Examples of cyan dyes include C.I. Acid Blue 1, 7, 9, 15, 22, 23, 25, 27, 29, 40, 41, 43, 45, 54, 59, 60, 62, 72, 74, 78, 80, 82, 83, 90, 92, 93, 100, 102, 103, 104, 112, 113, 117, 120, 126, 127, 129, 130, 131, 138, 140, 142, 143, 151, 154, 158, 161, 166, 167, 168, 170, 171, 182, 183, 184, 187, 192, 199, 203, 204, 205, 229, 234, 236, and 249; C.I. Direct Blue 1, 2, 6, 15, 22, 25, 41, 71, 76, 77, 78, 80, 86, 87, 90, 98, 106, 108, 120, 123, 158, 160, 163, 165, 168, 192, 193, 194, 195, 196, 199, 200, 201, 202, 203, 207, 225, 226, 236, 237, 246, 248, and 249; C.I. Reactive Blue 1, 2, 3, 4, 5, 7, 8, 9, 13, 14, 15, 17, 18, 19, 20, 21, 25, 26, 27, 28, 29, 31, 32, 33, 34, 37, 38, 39, 40, 41, 43, 44, and 46; C.I. Solubilized Vat Blue 1, 5, and 41; C.I. Vat Blue 4, 29, and 60; C.I. Food Blue 1 and 2; and C.I. Basic Blue 9, 25, 28, 29, and 44.

The color ink composition may contain any amount of the coloring material. The content of the coloring material is preferably 1% by mass or more and 20% by mass or less, more preferably 1% by mass or more and 10% by mass or less, based on the total mass of the ink.

The organic solvent, the surfactant, and other components contained in the color ink composition may be those exemplified as those contained in the white ink composition or the protective ink composition.

In the ink jet recording process according to this embodiment, a recorded matter having satisfactory glitter can be further provided with high scratch resistance and an improvement in design by color metallic glitter.

In this embodiment, the pressing step is performed prior to the protective layer-forming step and the color image-forming step. Alternatively, the pressing step may be performed after the protective layer-forming step and the color image-forming step.

Recorded Matter

The recorded matter according to the invention is produced by the ink jet recording process according to the invention and can be prepared as a recorded matter having a glitter image with high glossiness formed on a surface of a recording medium.

Ink Jet Recording Apparatus

The ink jet recording apparatus that forms a glitter image by the ink jet recording process according to the invention may be any apparatus having a glitter image-forming unit and a pressing unit.

The ink jet recording apparatus preferably further includes transporting units, each for transporting a recording medium between a unit and a unit, and a controller for controlling these units. The apparatus more preferably includes a pretreatment unit, a base layer-forming unit, a protective layer-forming unit, and a color image-forming unit.

The glitter image-forming unit is a head including an ink jet nozzle for discharging a glitter ink composition and preferably further includes a head driving mechanism, a carriage, and other components.

The pressing unit may have any mechanism that can press a recording medium. Examples of the mechanism include a pressing mechanism using a supporting table for supporting a recording medium and a pressing plate facing the supporting table and pressing the recording medium disposed therebetween and a mechanism using rollers for pressing a recording medium therebetween. The pressing mechanism preferably uses a hot press machine including a heating plate. The heating plate may be made of any material such as a metal or ceramic.

The pressing unit is not limited to those utilizing the hot press mechanism and may be a pressing means (optionally having a heating mechanism) using a roller, iron, or another tool.

The pretreatment unit may be any unit that can apply the pretreatment solution to a recording medium and includes, for example, a head having an ink jet nozzle for discharging the pretreatment solution or an application roller.

The base layer-forming unit may be any unit that can apply a base ink composition to a recording medium and includes, for example, a head having an ink jet nozzle for discharging the base ink solution or an application roller.

The protective layer-forming unit may be any unit that can apply a protective ink composition to a recording medium and includes, for example, a head having an ink jet nozzle for discharging the protective ink solution or an application roller.

The color image-forming unit may be any unit that can apply a color ink composition to a recording medium and includes, for example, a head having an ink jet nozzle for discharging the color ink solution or an application roller.

The glitter image-forming unit, the pretreatment unit, the base layer-forming unit, the protective layer-forming unit, and the color image-forming unit are not necessarily required to have the respective heads. For example, these units may be integrated into a single head and use common head-driving mechanism, carriage, and other components. The transporting units and the controlling unit for controlling them preferably have a function of transporting a recording medium according to the ink jet recording process.

EXAMPLES AND COMPARATIVE EXAMPLES

The ink jet recording process and the recorded matter according to the invention will now be described in detail by examples and comparative examples, which should not limit the scope of the invention.

Preparation of Glitter Ink Composition

In this example, a water resistant aluminum pigment dispersion was prepared using aluminum pigment particles (average particle diameter R50: 1 μm), as the glitter pigment, coated with silica using tetraethoxysilane as a silica source.

The water resistant aluminum pigment dispersion, 1,2-hexanediol, an urethane resin (trade name: Rezamin D 1060, manufactured by Dainichiseika Color & Chemicals Mfg. Co., Ltd.), diethylene glycol diethyl ether, propylene glycol, 2-pyrrolidone, an acetylene glycol surfactant (trade name: Olfine E1010, manufactured by Nissin Chemical Industry Co., Ltd.), triethanolamine, and deionized water were mixed and stirred at the following composition:

Water resistant aluminum pigment dispersion (solid content): 1.5% by mass
1,2-Hexanediol: 5% by mass
Urethane resin: 0.1% by mass
Diethylene glycol diethyl ether: 1% by mass
Propylene glycol: 50% by mass
2-Pyrrolidone: 5% by mass
Olfine E1010: 1% by mass
Triethanolamine: 0.4% by mass
Deionized water: the remainder
Total: 100% by mass Preparation of White Ink Composition Metal oxide titanium dioxide (trade name: NanoTek® Slurry, manufactured by C. I. Kasei Co., Ltd.), urethane resin (trade name: Rezamin D 1060, manufactured by Dainichiseika Color & Chemicals Mfg. Co., Ltd.), glycerin, 1,2-hexanediol, triethanolamine, BYK-348 (manufactured by BYK-Chemie Japan, Inc.), and deionized water were mixed and stirred at the following composition:

Metal oxide titanium dioxide: 10% by mass
Urethane resin: 10% by mass
Glycerin: 10% by mass
1,2-Hexanediol: 3% by mass
Triethanolamine: 0.5% by mass
BYK-348: 0.5% by mass
Deionized water: the remainder
Total: 100% by mass Preparation of Pretreatment Solution Calcium nitrate tetrahydrate, an acetylene glycol surfactant (trade name: Olfine E1010, manufactured by Nissin Chemical Industry Co., Ltd.), and deionized water were mixed and stirred at the following composition:

Calcium nitrate tetrahydrate: 10% by mass
Olfine E1010: 0.5% by mass
Deionized water: the remainder
Total: 100% by mass Preparation of Protective Ink Composition 1,2-Hexanediol, trimethylolpropane, acetylene glycol surfactant (trade name: Olfine E1010, manufactured by Nissin Chemical Industry Co., Ltd.), triethanolamine (pH adjuster), benzotriazole, ethylenediaminetetraacetic acid disodium salt, a urethane resin (trade name: Rezamin D 1060, manufactured by Dainichiseika Color & Chemicals Mfg. Co., Ltd.), and deionized water were mixed at the following composition:

1,2-Hexanediol: 2% by mass
Trimethylolpropane: 25% by mass
Olfine E1010: 0.5% by mass
Triethanolamine: 0.3% by mass
Benzotriazole: 0.01% by mass
Ethylenediaminetetraacetic acid disodium salt: 0.02% by mass
Urethane resin: 1.5% by mass
Deionized water: the remainder
Total: 100% by mass Preparation of Color Ink Composition The color ink composition used was:

Magenta ink (ICM37, manufactured by Seiko Epson Corporation)

Recorded matters as examples were produced according to the above-described embodiments using the prepared ink compositions and pretreatment solution.

Example 1

A recorded matter was produced according to the ink jet recording process described in the first embodiment.

Example 2

A recorded matter was produced according to the ink jet recording process described in the second embodiment.

Example 3

A recorded matter was produced according to the ink jet recording process described in the third embodiment.

Comparative Example 1

A recorded matter was produced only by the glitter image-forming step.

Example 4

A recorded matter was produced according to the ink jet recording process described in the first embodiment. The pressing step was performed such that the difference between the arithmetic mean roughnesses Ra of the glitter image before and after the pressing step was 1.5 μm.

Comparative Example 2

A recorded matter was produced according to the ink jet recording process described in the second embodiment except that the pressing step was performed such that the difference between the arithmetic mean roughnesses Ra of the glitter image before and after the pressing step was 0.5 μm.

Example 5

A recorded matter was produced according to the ink jet recording process described in the second embodiment such that the residual rate of the solvent component at the time of the pressing was 75% by mass.

Example 6

A recorded matter was produced according to the ink jet recording process described in the second embodiment such that the residual rate of the solvent component at the time of the pressing was 50% by mass.

Example 7

A recorded matter was produced according to the ink jet recording process described in the second embodiment such that the residual rate of the solvent component at the time of the pressing was 15% by mass.

Comparative Example 3

A recorded matter was produced according to the ink jet recording process described in the second embodiment such that the residual rate of the solvent component at the time of the pressing was 95% by mass.

Comparative Example 4

A recorded matter was produced according to the ink jet recording process described in the second embodiment such that the residual rate of the solvent component at the time of the pressing was 5% by mass.

Evaluation of Gloss

The resulting recorded matters were evaluated for gloss by visual observation based on the following criteria:

"AA": very good gloss (showing metallic gloss and bright metallic appearance),

"A": good gloss (showing metallic gloss and slightly dark metallic appearance),

"B": fair gloss (showing metallic gloss and dark metallic appearance), and

"C": poor gloss (not showing metallic gloss but showing dingy gray appearance).

The Results of Evaluation of Gloss

Table 1 shows the results of Examples 1 to 3 and Comparative Example 1; Table 2 shows the results of Example 4 and Comparative Example 2; and Table 3 shows the results of Examples 5 to 7 and Comparative Examples 3 and 4. Tables 1 to 3 demonstrate that satisfactory glitter can be obtained even on a rough surface of a recording medium in Examples of the invention.

The conditions for measuring surface roughness are shown below.

The arithmetic mean roughness (Ra) was measured with a Keyence ultra-depth color 3D profiling microscope (VK-9500 (controller unit)/VK-9510 (measurement unit)) in accordance with JIS B 0601-2001. The apparatus was set to the following measurement conditions:

Magnification of objective lens: 10×
Magnification on a 15-times magnification monitor: 200
Range of observation and measurement (width): 1350 μm
Range of observation and measurement (length): 1012 μm
Height measurement display resolution: 0.01 μm
Laser wavelength: 408 nm
Objective lens: 10× standard lens
Optical zoom: 1×
Z measurement distance: 500 μm
Measurement pitch: 0.5 μm
Shutter speed: automatic
Gain: 930
ND filter: 1

TABLE 1

| | | Example 1 | Example 2 | Example 3 | Comparative Example 1 |
|---|---|---|---|---|---|
| Step | Pretreatment | N | N | Y | N |
| | Base layer formation | N | Y | Y | N |
| | Glitter layer image formation | Y | Y | Y | Y |
| | Pressing | Y | Y | Y | N |
| Results of evaluation of glitter | | B | A | AA | C |

Y: performed
N: not performed

TABLE 2

| | | Example 4 | Comparative Example 2 |
|---|---|---|---|
| Step | Pretreatment | N | N |
| | Base layer formation | N | Y |
| | Glitter layer image formation | Y | Y |
| | Pressing | Y | Y |
| | Difference in Ra between before and after pressing | 1.5 μm | 0.5 μm |
| | Results of evaluation of glitter | B | C |

Y: performed
N: not performed

TABLE 3

| | | Example 5 | Example 6 | Example 7 | Comparative Example 3 | Comparative Example 4 |
|---|---|---|---|---|---|---|
| Step | Pretreatment | N | N | N | N | N |
| | Base layer formation | Y | Y | Y | Y | Y |
| | Glitter layer image formation | Y | Y | Y | Y | Y |

TABLE 3-continued

| | Example 5 | Example 6 | Example 7 | Comparative Example 3 | Comparative Example 4 |
|---|---|---|---|---|---|
| Residual rate of solvent component | 75 wt % | 50 wt % | 15 wt % | 95 wt % | 5 wt % |
| Pressing | Y | Y | Y | Y | Y |
| Results of evaluation of glitter | A | A | B | C | C |

Y: performed
N: not performed

Change in Glossiness by Difference in Surface Tension of Ink

The influence of a difference in surface tension between the glitter ink composition and the base ink composition (white ink composition) on glossiness was verified.

Preparation of Glitter Ink Composition for Experimental Example

In this experimental example, a water resistant aluminum pigment dispersion was prepared using aluminum pigment particles (average particle diameter R50:1 μm), as the glitter pigment, coated with silica using tetraethoxysilane as a silica source. Glitter ink compositions A to D having compositions shown in Table 4 were prepared by mixing and stirring the water resistant aluminum pigment dispersion, a fluorosurfactant (trade name: Megafac F553, manufactured by DIC Corporation), a polysiloxane surfactant (trade name: BYK-348, manufactured by BYK-Chemie Japan, Inc.), an acetylene glycol surfactant (trade name: Olfine E1010, manufactured by Nissin Chemical Industry Co., Ltd.), triethanolamine, propylene glycol, 2-methyl-2,4-pentanediol (abbreviated to "2M24PD" in the table), and deionized water.

The surface tension of each of the resulting glitter ink compositions A to D was measured with an automatic surface tension balance CBVP-Z (trade name, manufactured by Kyowa Interface Science Co., Ltd.) at an ink temperature of 23° C. The surface tension $S_1$ of each of glitter ink compositions A to D is shown in Table 4.

TABLE 4

| | Glitter ink composition | | | |
|---|---|---|---|---|
| | A | B | C | D |
| Water resistant aluminum pigment dispersion | 1.2 | 1.2 | 1.2 | 1.2 |
| Megafac F553 | 0.36 | 0.36 | 0 | 0 |
| BYK-348 | 0.3 | 0 | 0.3 | 0 |
| Olfine E1010 | 1 | 0 | 0 | 1 |
| Triethanolamine | 0.3 | 0.3 | 0.3 | 0.3 |
| Propylene glycol | 28 | 28 | 28 | 28 |
| 2M24PD | 12 | 12 | 12 | 12 |
| Deionized water | remainder | remainder | remainder | remainder |
| Total (% by mass) | 100 | 100 | 100 | 100 |
| Surface tension $S_1$ (mN/m) | 20.5 | 24.1 | 23.9 | 32.6 |

Preparation of White Ink Composition for Experimental Example

In this experimental example, the same white ink composition used in the examples described above was used. The surface tension of the white ink composition was measured as in glitter ink compositions A to D. The surface tension $S_2$ of the white ink composition was 25.2 mN/m.

Preparation of Pretreatment Solution for Experimental Example

In this experimental example, the same white ink composition used in the examples described above was used.

Evaluation of Gloss

The influence of a difference in surface tension between the glitter ink composition and the base ink composition (white ink composition) on glossiness was investigated from the point of view of gloss.

The pretreatment solution was applied onto a recording medium (black fabric of 100% cotton) with a roll coater. Cartridges filled with glitter ink compositions A to D and the white ink composition were mounted on a modified ink jet recording apparatus PX-G5500. The white ink composition was discharged from the nozzle of the ink jet recording apparatus onto the region where the pretreatment solution was applied at a Duty of 200% to form a base layer, followed by drying so that the residual rate of the solvent component of the white ink composition forming the base layer was decreased to 50%. Subsequently, the glitter ink composition was discharged at a Duty of 50% to form a glitter image on the base layer. Subsequently, a pressing step of pressing the glitter image was performed. The pressing step was performed as in Example 4 such that the difference between the arithmetic mean roughnesses Ra of the glitter image before and after the pressing step was 1.5 μm. Thus, glitter images of experimental examples 1 to 4 were prepared.

The gloss of the glitter images of experimental examples 1 to 3 were visually compared with the gloss of the glitter image of experimental example 4. The results were determined as follows:

Excellent: gloss superior to that of the glitter image of experimental example 4, and Poor: gloss inferior to that of the glitter image of experimental example 4.

Evaluation of Glossiness

The influence of a difference in surface tension between the glitter ink composition and the base ink composition (white ink composition) on glossiness was investigated from the point of view of the value of glossiness.

The glitter images of experimental examples 1 to 4 prepared in the "Evaluation of glossiness" were measured for glossiness at 60° with a gloss meter MULTI Gloss 268 (product name, manufactured by Konica Minolta, Inc.).

Results of Evaluation of Gloss and Glossiness

Table 5 shows the results of evaluation of gloss and glossiness.

TABLE 5

| | Experimental example 1 | Experimental example 2 | Experimental example 3 | Experimental example 4 |
|---|---|---|---|---|
| Glitter ink composition | A | B | C | D |
| Difference in surface tension ($S_2 - S_1$) | 4.7 | 1.1 | 1.3 | −7.4 |

TABLE 5-continued

| | Experimental example 1 | Experimental example 2 | Experimental example 3 | Experimental example 4 |
|---|---|---|---|---|
| Gloss | Excellent | Excellent | Excellent | — |
| Glossiness at 60° | 9 | 10 | 10 | 2 |

It was observed that the metallic gloss (glitter) of each of the glitter images of experimental examples 1 to 3 was superior to that of the glitter image of experimental example 4. It was also visually observed that the degrees of reflection of light of the glitter images of experimental examples 1 to 3 were also higher than that of the glitter image of experimental example 4. Furthermore, the values of the glossiness demonstrate that the glossiness of each glitter image of experimental examples 1 to 3 was obviously higher than that of the glitter image of experimental example 4. Accordingly, it was shown that the metallic gloss (glitter) is increased when the surface tension $S_1$ of the glitter ink composition is smaller than the surface tension $S_2$ of the white ink composition.

The values of the glossiness were all relatively low. This is supposed to be caused by the use of fabric having a rough surface as the recording medium and the individual variations in glitter such as metallic gloss and in glossiness corresponding to reflection of light due to individual observers.

What is claimed is:

1. An ink jet recording process comprising the steps of:

forming a base layer for a glitter image by applying a base ink composition containing base particles to a recording medium;

forming the glitter image by discharging a glitter ink composition containing a glitter pigment to the recording medium;

pressing the recording medium; and forming a color image by applying a color ink composition containing a coloring material onto at least part of the glitter image, after the step of pressing;

wherein in the step of forming the base layer, the base ink composition containing solvent component being applied to the recording medium, the solvent component composing water and/or an organic solvent;

in the step of forming the glitter image, when the glitter ink is discharged, the residual rate of the solvent component in the base ink composition is 10% by mass or more and 80% by mass or less; and in the step of pressing the recording medium, the base layer has a fluidity during the pressing such that the glitter of a resulting recorded matter is provided with sufficient glitter.

2. The ink jet recording process according to claim 1, wherein the glitter ink composition has a surface tension of 30 mN/m or less.

3. The ink jet recording process according to claim 1, wherein the glitter ink composition has a surface tension lower than that of the base ink composition.

4. The ink jet recording process according to claim 1, wherein the process further comprising a step of:

applying, before the step of forming the base layer, a pretreatment solution containing a coagulant capable of agglomerating the base particles contained in the base ink composition or the glitter pigment particles to the recording medium.

5. The ink jet recording process according to claim 1, after the step of pressing the recording medium, further comprising a step of:

forming a protective layer by applying a protective ink composition substantially not containing a coloring material onto at least part of the glitter image.

6. The ink jet recording process according to claim 1, wherein the recording medium is fabric.

7. The ink jet recording process according to claim 1, wherein the step of pressing is performed by pressing the recording medium provided with the glitter image under heating at a temperature of 40° C. or more and 250° C. or less.

8. The ink jet recording process according to claim 1, wherein the glitter image after the step of pressing has an arithmetic mean roughness (Ra2) of 10 μm or less.

9. A recorded matter prepared by the ink jet recording process according to claim 1.

10. An ink jet recording apparatus performing the ink jet recording process according to claim 1.

11. The ink jet recording process according to claim 1, wherein the glitter pigment is in a form of plate-like particles having a 50% mean particle diameter R50 of 0.25 μm or more and 5.0 μm or less based on the equivalent circle diameters determined from the X-Y plane areas of the plate-like particles.

12. The ink jet recording process according to claim 1, before the step of forming the base layer, further comprising a step of:

preparing the recording medium which contains a coagulant capable of agglomerating the base particles contained in the base ink composition or the glitter pigment particles.

13. An ink jet recording process comprising the steps of:

forming a base layer for a glitter image by applying a base ink composition containing base particles to a recording medium;

forming the glitter image by discharging a glitter ink composition containing a glitter pigment to the recording medium;

pressing the recording medium; and wherein in the step of forming the base layer, the base ink composition containing solvent component being applied to the recording medium, the solvent component composing water and/or an organic solvent, in the step of forming the glitter image, when the glitter ink is discharged, the residual rate of the solvent component in the base ink composition in 10% by mass or more and 80% by mass or less;

in the step of pressing the recording medium, the base layer has a fluidity during the pressing such that the glitter of a resulting recorded matter is provided with sufficient glitter; and the difference between an arithmetic mean roughness (Ra1) of a glitter image before the pressing step and an arithmetic mean roughness (Ra2) after the pressing step is 3 μm or more, and the arithmetic mean roughness (Ra2) after the pressing step is 10 μm or less.

14. The ink jet recording process according to claim 1, wherein the glitter ink composition has a surface tension of 30 mN/m or less.

15. The ink jet recording process according to claim 13, wherein the glitter ink composition has a surface tension lower than that of the base ink composition.

16. The ink jet recording process according to claim 13, wherein the process further comprising a step of:

applying, before the step of forming the base layer, a pretreatment solution containing a coagulant capable of agglomerating the base particles contained in the base ink composition or the glitter pigment particles to the recording medium.

17. The ink jet recording process according to claim 13, after the step of pressing the recording medium, further comprising a step of:

forming a protective layer by applying a protective ink composition substantially not containing a coloring material onto at least part of the glitter image.

18. The ink jet recording process according to claim 13, wherein the recording medium is fabric.

19. The ink jet recording process according to claim 13, wherein the step of pressing is performed by pressing the recording medium provided with the glitter image under heating at a temperature of 40° C. or more and 250° C. or less.

20. The ink jet recording process according to claim 13, wherein the glitter image after the step of pressing has an arithmetic mean roughness (Ra2) of 10 μm or less.

21. The ink jet recording process according to claim 13, wherein the glitter pigment is in a form of plate-like particles having a 50% mean particle diameter R50 of 0.25 μm or more and 5.0 μm or less based on the equivalent circle diameters determined from the X-Y plane areas of the plate-like particles.

22. The ink jet recording process according to claim 13, before the step of forming the base layer, further comprising a step of:

preparing the recording medium which contains a coagulant capable of agglomerating the base particles contained in the base ink composition or the glitter pigment particles.

23. The ink jet recording process according to claim 13, after the step of pressing the recording medium further comprising the steps of:

forming a color image by applying a color ink composition containing a coloring material onto at least part of the glitter image, after the step of forming the glitter image and the step of pressing.

* * * * *